US006529117B1

(12) United States Patent
Narusawa

(10) Patent No.: US 6,529,117 B1
(45) Date of Patent: Mar. 4, 2003

(54) RADIO SELECTIVE CALL RECEIVER IN WHICH MESSAGE NON-RECEPTION PERIOD IS MANAGED

(75) Inventor: Hideki Narusawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/426,693

(22) Filed: Oct. 25, 1999

(30) Foreign Application Priority Data

Nov. 19, 1998 (JP) ..... 10-330064

(51) Int. Cl.[7] ..... G08B 5/22

(52) U.S. Cl. ..... 340/7.52; 340/7.39; 340/7.51; 340/7.27; 455/234.1

(58) Field of Search ..... 340/7.52, 7.39, 340/7.51, 7.27, 7.28, 7.32, 7.34, 7.38, 7.56, 7.58, 825.21; 455/234.1, 525, 343, 426, 226.1, 226.2, 296, 552

(56) References Cited

FOREIGN PATENT DOCUMENTS

| | | |
|---|---|---|
| JP | 5-300075 | 11/1993 |
| JP | 6-61920 | 3/1994 |
| JP | 6-120869 | 4/1994 |
| JP | 9-322213 | 12/1997 |
| JP | 10-191416 | 7/1998 |

*Primary Examiner*—Daryl C Pope
(74) *Attorney, Agent, or Firm*—Scully, Scott, Murphy & Presser

(57) ABSTRACT

A radio selective call receiver includes a receiving section, a recognizing section, an alarm section and a control section. The receiving section receives a radio signal. The recognizing section detects a message and a selective call number from the received radio signal, and recognizes selectively a reception time of the message as a latest reception time based on a kind of the selective call number. The alarm section generates an alarm in response to an alarm instruction. The control section compares at a comparison timing, a time difference between a current time and the latest reception time and a predetermined time period, and selectively outputs the alarm instruction to the alarm section based on the comparing result.

18 Claims, 6 Drawing Sheets

RADIO SELECTIVE CALL RECEIVER IN WHICH MESSAGE NON-RECEPTION PERIOD IS MANAGED

BACKGROUND OF THE INVENTION

1. Field of the Invention

The present invention relates to a radio selective call receiver, and more particularly, to a radio selective call receiver which can notify a non-reception period of a message.

2. Description of the Related Art

A service to a radio selective call receiver has been spreading. In case of a telephone service, an originator charging system is being introduced.

A conventional radio selective call receiver is described in Japanese Laid Open Patent Application (JP-A-Heisei 9-322213). In this technique, the radio selective call receiver can cope with a contract reception management.

Also, a conventional radio selective call receiver is disclosed in Japanese Laid Open Patent Application (JP-A-Heisei 10-191416). In this reference, in the radio selective call-receiver, the confirmation of a reception message and the management of usage fee in a quantity-based fee charging system are facilitated.

With introduction of the origination-base fee charging system, a radio selective calling receiver is sold in the state which a selective call number is already registered on. Procedures of a user with a conventional service provider such as payment of a monthly basic fee becomes unnecessary fully. The user can simply buy and immediately use a radio selective call receiver. Also, when the utility value of the radio selective call receiver runs out, the user can stop use of the receiver without any troublesome procedure. On the other hand, it becomes almost impossible for the service provider to manage the sold radio selective call receiver.

By adopting the origination-base fee charging system, the service provider could recognize the use situation of each radio selective call receiver based on the call record, and could stop the service to the radio selective call receiver in which there is no call during a predetermined time.

However, there is the possibility that service is stopped based on the call record of the message destined to the user, regardless of whether the user uses the radio selective call receiver actually. Moreover, the problem would occur that the user does not recognize that service has been stopped because of few call frequencies.

Therefore, in the radio selective call receiver, a function to manage the use situation of the service based on the call record and a function to avoid the stop of the service beforehand are demanded.

In conjunction with the above description, a radio selective call receiver is disclosed in Japanese Laid Open Patent Application (JP-A-Heisei 5-300075). In this reference, the radio selective call receiver is composed of an antenna (1), a radio section (2), a waveform shaping circuit (3), a decoder (4), a CPU (5), an ID-ROM (6), a driver section (7), a memory (8), a speaker (9), an LED (10), a power switch (11) and a notifying operation stop switch (12). A counter (51) of the CPU (5) counts time from a notifying operation start time to a notifying operation automatic stop time. A counter (52) of the CPU (5) counts time from the notifying operation automatic stop time to an operation of the switch (12). The CPU (5) selects one of the notifying operation contents based on the time counted by he counter (52).

Also, a radio selective call receiver is disclosed in Japanese Laid Open Patent Application (JP-A-Heisei 6-61920). In this reference, a schedule control section (8) issues a control signal to a CPU (6) at an alarm notifying time which has been preset through an execution of a schedule function. The CPU (6) determines whether any message not yet read out is present in an EEPROM (7), in response to the control signal. The CPU (6) notifies that any message not yet read out is present, by an alarm which is changed based on a schedule alarm.

Also, a radio selective call receiver is disclosed in Japanese Laid Open Patent Application (JP-A-Heisei 6-120869). In this reference, a decoder (14) extracts a call signal and a message signal from a selective call signal Sa which has been received and demodulated by a reception/demodulation section (12), and determines whether the selective call signal is destined to a user. A CPU (20) stores a message corresponding to the message signal in a message memory (21). Also, the CPU (20) temporarily stores a serial number in a buffer (23) and calculates a difference between the serial number and a serial number immediately before the reception. When the difference is equal to or more than 2, a alert signal FA is outputted from a non-reception alert signal generator (17).

SUMMARY OF THE INVENTION

Therefore, an object of the present invention is to provide a radio selective call receiver which has a function to avoid the stop of a service beforehand based on a call record of the radio selective call receiver.

Another object of the present invention is to provide a radio selective call receiver which a function to recognize a call record based on a kind of a selective call number and a function to avoid use stop of a service beforehand.

In order to achieve an aspect of the present invention, a radio selective call receiver includes a receiving section, a recognizing section, an alarm section and a control section. The receiving section receives a radio signal. The recognizing section detects a message and a selective call number from the received radio signal, and recognizes selectively a reception time of the message as a latest reception time based on a kind of the selective call number. The alarm section generates an alarm in response to an alarm instruction. The control section compares at a comparison timing, a time difference between a current time and the latest reception time and a predetermined time period, and selectively outputs the alarm instruction to the alarm section based on the comparing result.

Here, the recognizing section recognizes the reception time of the message when the selective call number is one selective call numbers corresponding to individual call messages destined to a user. Alternatively, the recognizing section recognizes the reception time of the message when the selective call number is one of a preset ones of selective call numbers corresponding to individual call messages destined to a user and selective call numbers corresponding to information messages.

Also, when the radio selective call receiver further includes a storage section, the recognizing section stores the latest reception time in the storage section. The control section reads out the latest reception time from the storage section at the comparison timing, and compares the time difference between the current time and the latest reception time and the predetermined time period. In this case, the comparison timing is predetermined. Also, the comparison timing may be a changing timing of date.

Further, the control section outputs the alarm instruction to the alarm section when the time difference is larger than the predetermined time period. When the time difference is equal to or smaller than the predetermined time period, the control section returns to a call waiting state without outputting the alarm instruction to the alarm section. In this case, it is preferable that the predetermined time period is shorter than a time period for which a service is effective.

In order to achieve another aspect of the present invention, a method of managing a time difference between message receptions in a radio selective call receiver, includes:

detecting a message and a selective call number from a received radio signal;

recognizing selectively a reception time of the message as a latest reception time based on a kind of the selective call number;

comparing at a comparison timing, a time difference between a current time and the latest reception time and a predetermined time period;

generating an alarm based on the comparing result.

Here, the reception time of the message is recognized when the selective call number is one selective call numbers corresponding to individual call messages destined to a user. Alternatively, the reception time of the message is recognized when the selective call number is one of a preset ones of selective call numbers corresponding to individual call messages destined to a user and selective call numbers corresponding to information messages.

When the latest reception time is stored in a storage section, the latest reception time is read out from the storage section at the comparison timing, and the time difference between the current time and the latest reception time and the predetermined time period is compared. The comparison timing may be predetermined to be a changing timing of date.

An alarm is generated when the time difference is larger than the predetermined time period. When the time difference is equal to or smaller than the predetermined time period, the control returns to a call waiting state without generating the alarm. The predetermined time period may be shorter than a time period for which a service is effective.

DESCRIPTION OF THE PREFERRED EMBODIMENTS

The radio selective call receiver of the present invention will be described below in detail with reference to the attached drawings.

Figure 1:
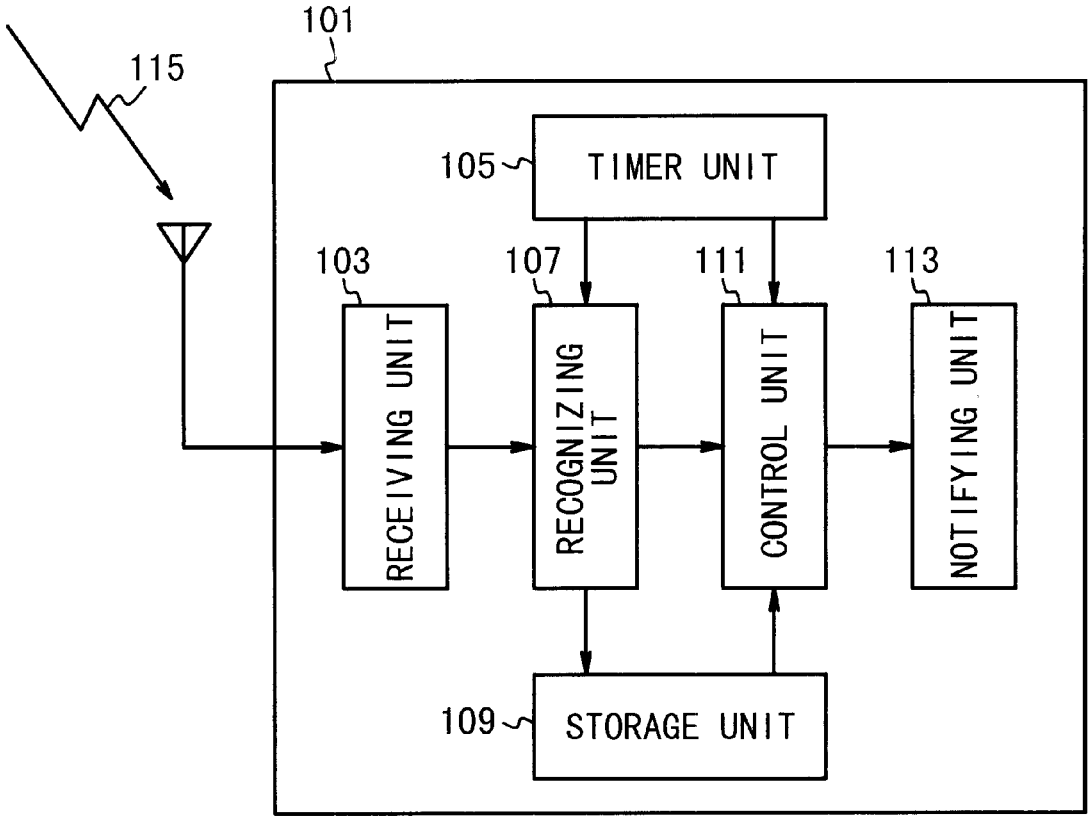
FIG. 1 is a functional block diagram of a radio selective call receiver of the present invention.

FIG. 1 is a functional block diagram of the radio selective call receiver of the present invention. The radio selective call receiver 101 of the present invention is composed of a receiving unit 103, a timer unit 105, a recognizing unit 107, a storage unit 109, a control unit 111 and a notifying unit 113.

The receiving unit 103 receives a radio signal 115. Also, the receiving unit 103 carries out a demodulating process to the received radio signal. The radio signal 115 contains a message which should be received and a selective call number corresponding to the message. The timer unit 105 counts the current time.

The recognizing unit 107 recognizes the latest reception time of the message corresponding to the selective call number based on a kind of the selective call number. The selective call number is acquired from the received radio signal. When the selective call number acquired from the received radio signal is coincident with at least one of the selective call numbers allocated to the receiver 101, the recognizing unit 107 recognizes the latest reception time of the message corresponding to the selective call number. The selective call numbers are previously stored in the storage section 109.

In the present invention, the recognizing unit 107 recognizes the latest reception time of the message corresponding to the selective call number, when the selective call number acquired from the received radio signal is coincident with one of the selective call number for the individual message destined to the user as the kind of the selective call number. The selective call number for the individual message destined to the user forms at least one selective call number and is previously stored in the storage unit 109.

The storage section 109 stores a data indicative of a previously set comparison timing, a reference time and the latest reception time recognized by the recognizing unit 107. For example, the comparison timing is previously set at the timing of the change of date, i.e., 00:00. The reference time is previously set as the non-reception period of the message.

The control unit 111 calculates a time difference from the latest reception time recognized and the current time at the previously set comparison timing. The control unit 111 generates a notice instruction when the calculated time difference is larger than the reference time previously set.

When the current time from the timer unit 105 is substantially coincident with the comparison timing previously set in the storage section 109, the control unit 111 calculates the time difference from the recognized latest reception time and the current time and compares the previously set reference time and the calculated time difference. The comparison timing may be set to a timing other than the change of date, and a plurality of comparison timings may be set per a day.

The control unit 111 generates the notice instruction when the calculated time difference is larger than the reference time previously set. The notifying unit 113 generates an alarm in response to the notice instruction from the control unit 111.

Figure 2:
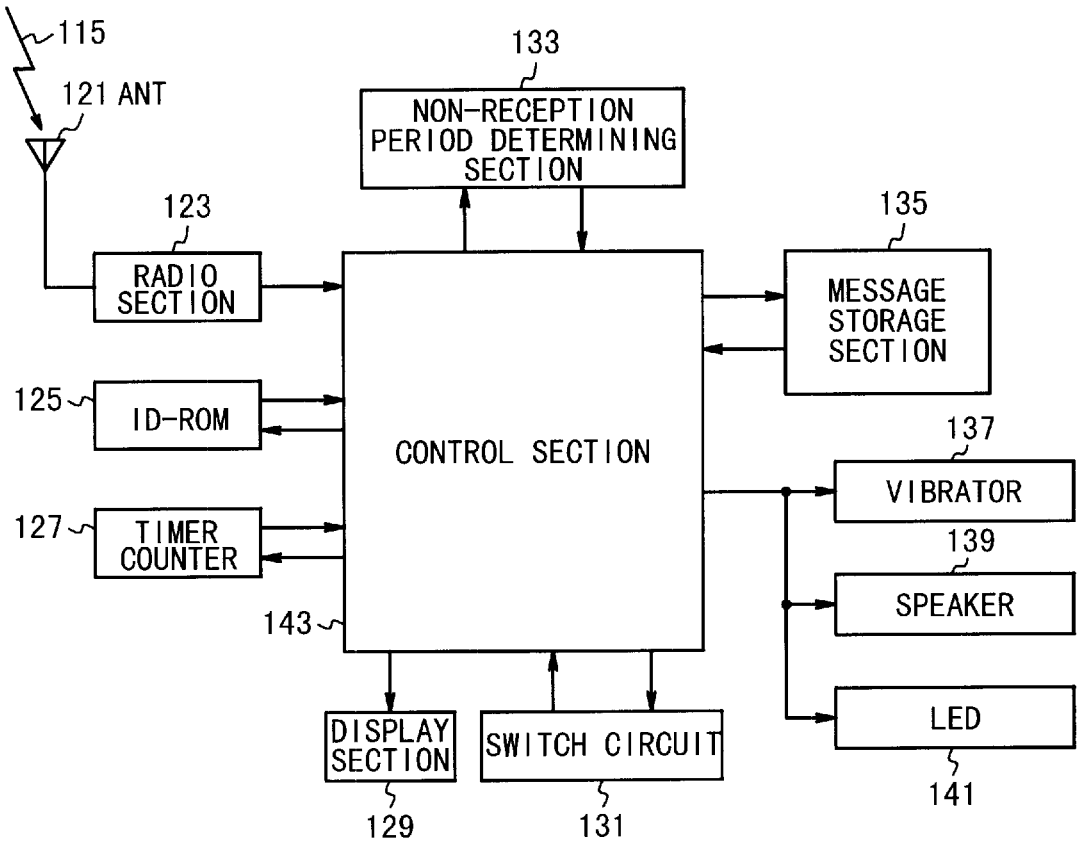
FIG. 2 is a block diagram showing the structure of a radio selective call receiver according to a first embodiment of the present invention.

FIG. 2 is a block diagram showing the structure of the radio selective call receiver according to the first embodiment of the present invention. Referring to FIG. 2, the radio selective call receiver is composed of an,antenna (ANT) 121, a radio section 123, an ID-ROM 125, a time counting counter 127 and a control section 143.

Also, the radio selective call receiver is further composed of a display section 129, a switch circuit 131, a non-reception period determining section 133, a message storage section 135, a vibrator 137, a speaker 139 and a LED (Light Emission Device) 141.

Either of the vibrator 137, the speaker 139 and the LED 141 or a combination of them functions as the notifying unit 113 in FIG. 1. Also, the timer counter 127 and the non-reception period determining section 133 may be provided in the control section 143 and are not limited to this embodiment.

The ID-ROM 125 previously stores at least one of selective call numbers corresponding to the individual messages destined to the user and at least one of selective call numbers corresponding to the information message. Also, the ID-ROM 125 stores the latest reception time together with the selective call number corresponding to the individual message, the comparison timing and the reference time. It should be noted that the comparison timing and the reference time are stored in the ID-ROM 125 together with the selective call number. Also, the comparison timing and the reference time are possible to be stored in the ID-ROM 125 using the control section 143, the display section 129 and the switch circuit 131, and they are possible to be changed.

The radio section 123 demodulates the radio signal 115 which has been received by the antenna ANT 1. The timer counter 127 counts or measures the current time. The display section 129 displays the received message (the individual message destined to the user, and the information message) and the current time.

Either of the vibrator 137, the speaker 139, the LED 141 or a combination of them functions as the notifying unit 113 in FIG. 1. The notifying unit 113 generates an alarm by use of the vibration, the sound, and the luminousness in response to a notice instruction from the control section 143. It should be noted that in this embodiment, the notifying section 113 (137, 139, 141) may be the section to give a notice to a user and is not limited to this embodiment.

The switch circuit 131 functions as the interface of the user operation such as ringing reset, display switching, corrected current time and reading of the stored message. The message storage section 135 stores all the received messages.

The non-reception period determining section 133 calculates a time difference between the current time from the timer counter 127 and the latest reception time which has been stored in the ID-ROM 125 at the time of the comparison timing which has been stored in the ID-ROM 125. The non-reception period determining section 133 judges whether or not the calculated time difference exceeds the reference time stored in the ID-ROM 125.

Next, an operation of the radio selective call receiver according to the first embodiment of the present invention will be described with reference to FIG. 2. First, the processing by the receiving section 103 is carried out. The antenna ANT 1 receives a radio signal 115. The radio section 123 carries out a demodulating process to the received radio signal.

Next, the processing by the recognizing section 107 is carried out. The control section 143 acquires the selective call number from the demodulated radio signal. The selective call number is acquired through a synchronizing process based on a reference clock signal (not shown). The control section 143 compares the acquired selective call number and the selective call numbers stored in the ID-ROM 125. When the acquired selective call number and at least one of the selective call numbers stored in the ID-ROM 125 are coincident with each other in the above-mentioned comparison timing, the control section 143 carries out a message receiving process.

Figure 3:
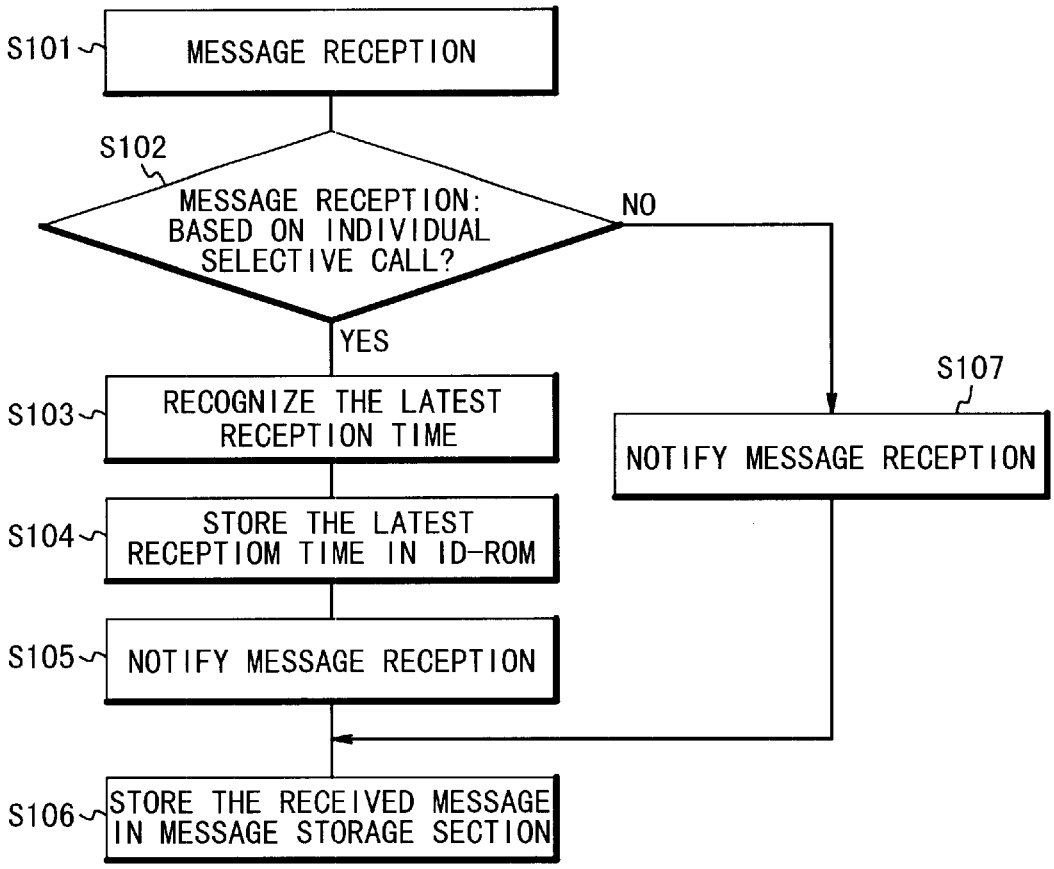
FIG. 3 is a flow chart to explain the operation of the radio selective call receiver according to the first embodiment of the present invention.

Referring to FIG. 3, when the acquired selective call number and at least one of the selective call numbers stored in the ID-ROM 125 are coincident with each other, the control section 143 judges that a message should be received (Step S101).

Next, the control section 143 determines whether or not the acquired selective call number is a selective call number for the individual message destined to the user (Step S102).

When the control section 143 judges at the step S102 that the acquired selective call number is the selective call number for the individual message destined to the user, the control section 143 recognizes the latest reception time of the individual message destined to the user (Step S103).

The recognized latest reception time is stored in the ID-ROM 125 in response to an instruction from the control section 143 (Step S104). Also, the control section 143 controls the vibrator 137, the speaker 139 and/or the LED to notify the message reception (Step S105).

Figure 4:
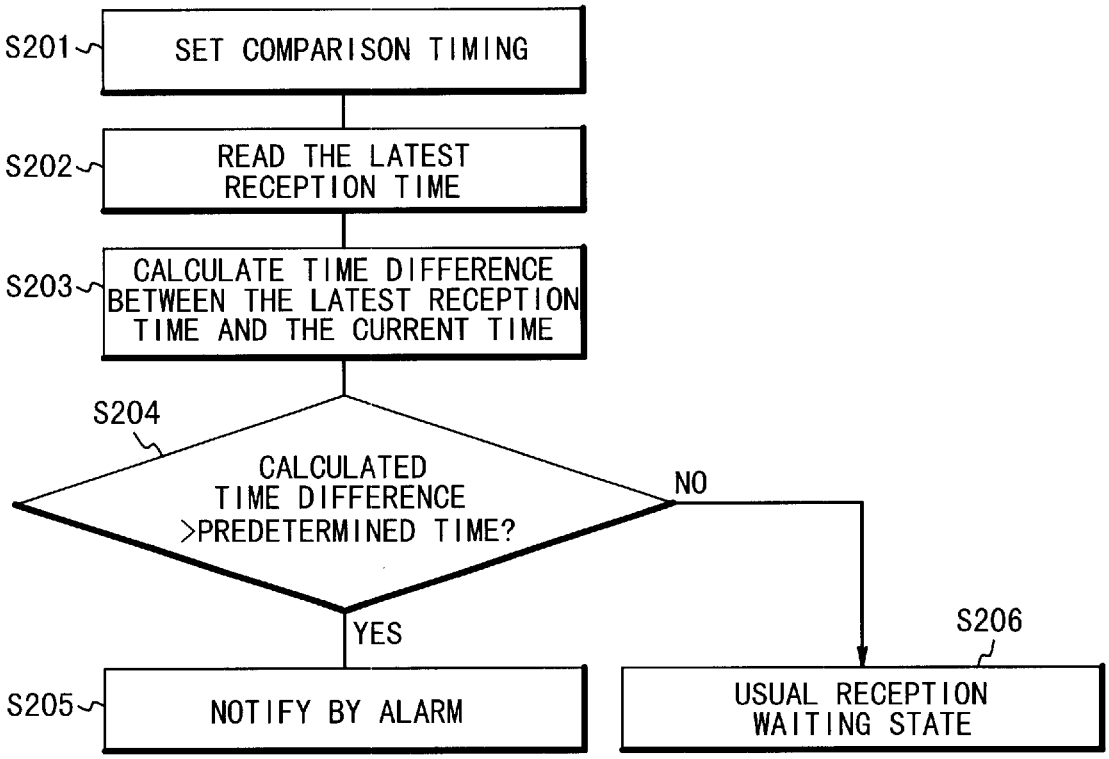
FIG. 4 is a flow chart to explain the operation of the radio selective call receiver according to a second embodiment of the present invention.

The received individual message destined to the user is stored in the message storage section 135 in response to an instruction from the control section 143 (Step S106). It should be noted that the processing of the recognizing section 107 shown in FIG. 3 is repeated until the processing of the control section 143 shown in FIG. 4 is carried out. Thus, the latest reception time is updated in response to the reception of the individual message destined to the user.

Also, when judging at the step S102 that the acquired selective call number is not the selective call number for the individual message destined to the user, the control section 143 judges that the acquired selective call number corresponds to the information message, and notifies information message reception, like the step S105 (Step S107). The received message is stored in the message storage section 11 in response to an instruction from the control section 143 (Step S106). The notifying operation (step S107) corresponding to the information message can be omitted through the setting previously.

Because the latest reception time of the individual message destined to the user is stored in the ID-ROM 125, the updated latest reception time is not erased when a master reset is carried out in a fault case such as power fail. Also, the storage section of the latest reception time is sufficient if the latest reception time is not erased in response to the master reset, and is not limited to this embodiment.

Next, a detecting operation during the message non-reception period by the control section 143 is executed. Referring to FIG. 4, the comparison timing is set to date change, e.g., 00:00 in this embodiment, as shown in FIG. 4.

The non-reception period determining section 133 compares the comparison timing and the current time measured by the timer counter 127. When judging that the comparison timing is coincident with the current time (Step S201), the non-reception period determining section 133 reads out the latest reception time stored in the ID-ROM 125 (Step S202).

Also, the non-reception period determining section 133 calculates a time difference between the current time and the read latest reception time (Step S203). Then, the non-reception period determining section 133 determines whether or not the calculated time difference is larger than the reference time stored in the ID-ROM 125 (Step S204).

When judging that the calculated time difference is larger than the reference time, the non-reception period determining section 133 notifies to the control section 143 that any message is not received for the reference time. The control section 143 issues a notice instruction to the notifying section 113 which is set previously, in response to the notice from the non-reception period determining section 133.

Next, the operation,by the notifying section 113 is carried out. The notifying section 113 being previously specified generates an alarm by the luminousness, the sound, the vibration in response to the notice instruction from the control section 143 (Step S205).

Also, when it is judged at the step S204 that the calculated time difference is not larger than the reference time stored in the ID-ROM 125, the non-reception period determining section 133 judges that the time period for which any message is not received is equal to or shorter than the reference time, and notifies to the control section 143 that a usual waiting state should be maintained (Step S206).

Through the above operation, when there is not a call to the radio selective call receiver itself for the above previously set reference time, an alarm is generated.

If this previously set reference time is set shorter than a predetermined time period set by a service provider in the origination charging system, the stop of the service provision can be prevented, because the alert is given to the user.

Next, the radio selective call receiver according to the second embodiment of the present invention will be described. The structure and operation of the radio selective call receiver according to this embodiment are the same as those of the above-mentioned first embodiment other than the recognizing section 107. In the second embodiment, the recognizing section 107 recognizes the latest reception time of the message corresponding to the selective call number based on the kind of the selective call number.

In the second embodiment, when the selective call number acquired from the received radio signal is coincident with at least one of the selective call numbers previously set in the ID-ROM 125, the recognizing section 107 recognizes the latest reception time of the message corresponding to the selective call number.

Figure 5:
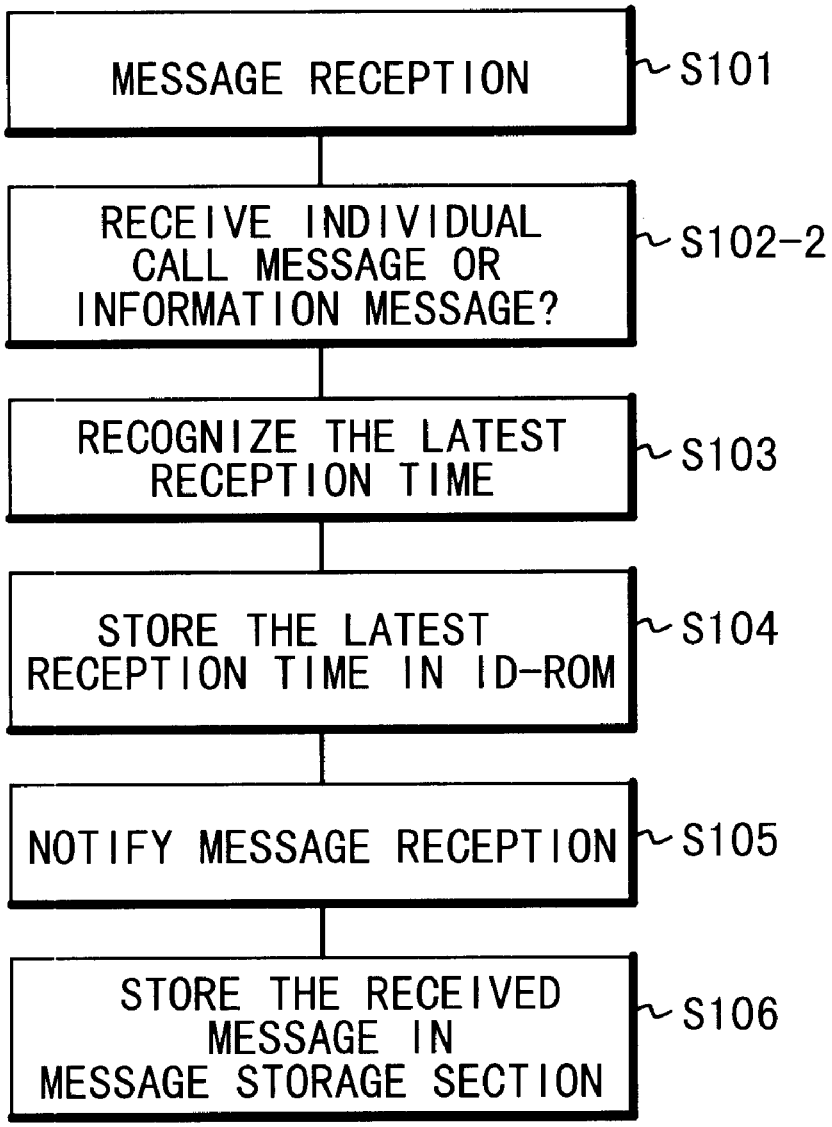
FIG. 5 is a flow chart to explain the operation of the radio selective call receiver according to a third embodiment of the present invention.

FIG. 5 shows a flow chart showing the operation of the radio selective call receiver according to the second embodiment. The above-mentioned step S102 in FIG. 3 is changed into a step S102-2 in FIG. 5. Also, the function to determine whether the received message is an individual message destined to the user or an information message is unnecessary, and the operation (step S107) to notify the reception of the information message is also omitted.

Next, the radio selective call receiver according to the third embodiment of the present invention will be described. The structure and operation of the radio selective call receiver according to the third embodiment are the same as those in the above-mentioned first embodiment other than the recognizing section 107. The recognizing section 107 recognizes the latest reception time of the message corresponding to the selective call number based on the kind of the selective call number.

In the third embodiment, when the selective call number acquired from the received radio signal is coincident with at least one of previously set ones of the selective call numbers for the individual message destined to the user and the selective call numbers for the information message, the recognizing section 107 recognizes the latest reception time of the message corresponding to the selective call number.

The selective call number for the individual message destined to the user and the selective call number for the information message are registered on a first table (not shown) which has been previously set and are previously stored in the ID-ROM 125. Moreover, in the third embodiment, at least one selective call number as the object to recognize the latest reception time of the message is registered on a second table (not shown) and is stored in the ID-ROM 125. The first and second tables may be provided in the ID-ROM 125.

The control section 143 as the recognizing section 107 refers to the first table based on the selective call number acquired from the received radio signal 115. When the acquired selective call number is coincident with at least one of the selective call numbers registered on the first table, the control section 143 refers to the second table.

When the acquired selective call number is coincident with either of the selective call numbers registered on the second table, the control section 143 recognizes the latest reception time of the message corresponding to the selective call number.

Figure 6:
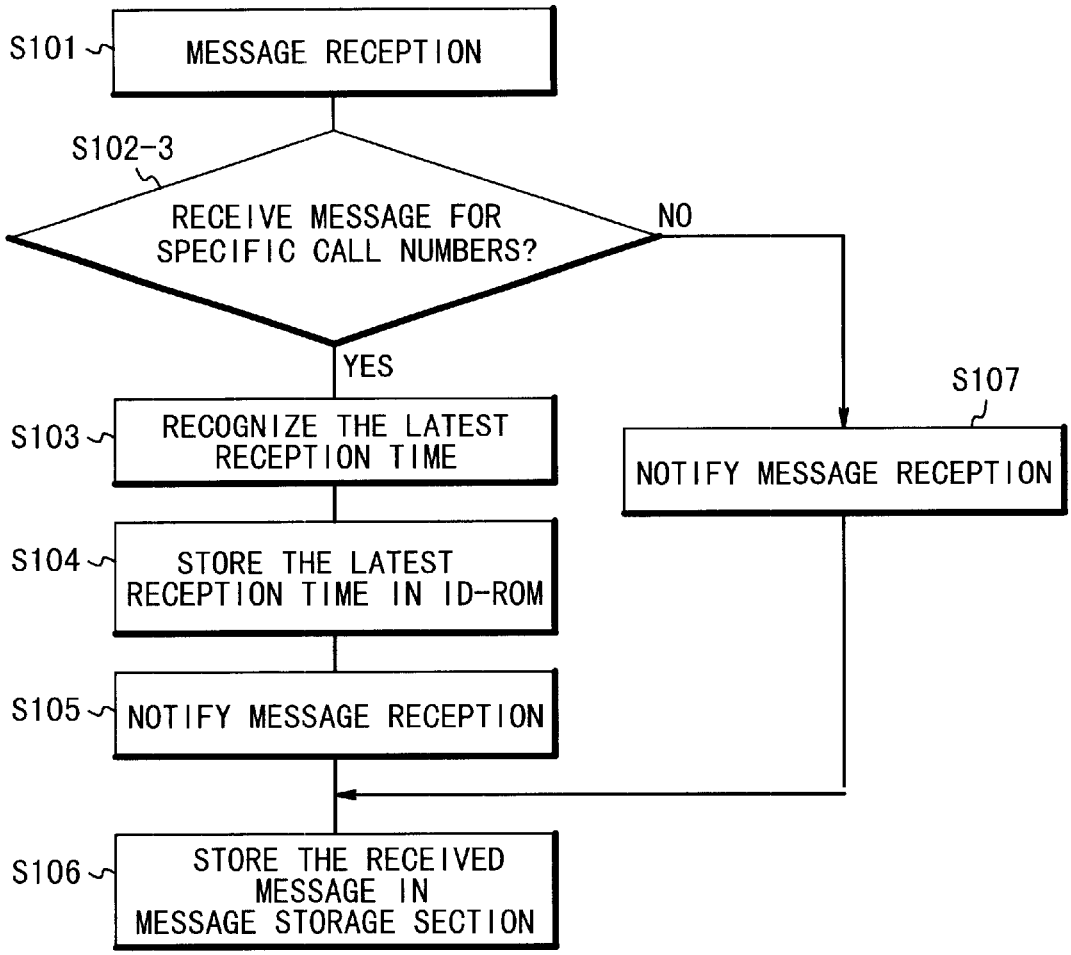
FIG. 6 is a flow chart to explain the operation of the radio selective call receiver according to the third embodiment of the present invention.

FIG. 6 is a flow chart showing the operation of the radio selective call receiver according to the third embodiment. In FIG. 6, the above-mentioned step S102 in FIG. 3 is changed into a step S102-3.

Referring to FIG. 6, at the step S102-3, the control section 143 as the recognizing section 107 recognizes the latest reception time of the message corresponding to the acquired selective call number, when the acquired selective call number is coincident with either of the selective call numbers previously set.

The above-mentioned step S107 in FIG. 3 is changed into the operation (step S107-3) to notify the reception of the messages corresponding to the selective call numbers other than the selective call numbers previously registered on the first table.

As described above, according to the radio selective call receiver of the present invention, the stop of the service can be avoided previously based on the call record of radio selective call receiver itself.

What is claimed is:

1. A radio selective call receiver comprising:

a receiving section receiving a radio signal;

a recognizing section detecting a message and a selective call number from the received radio signal, and recognizing selectively a reception time of said message as a latest reception time based on a kind of said selective call number;

an alarm section generating an alarm in response to an alarm instruction; and a control section comparing at a comparison timing, a time difference between a current time and said latest reception time and a predetermined time period, and selectively outputting said alarm instruction to said alarm section based on the comparing result.

2. A radio selective call receiver according to claim 1, wherein said recognizing section recognizes said reception time of said message when said selective call number is one selective call numbers corresponding to individual call messages destined to a user.

3. A radio selective call receiver according to claim 1, wherein said recognizing section recognizes said reception time of said message when said selective call number is one of a preset ones of selective call numbers corresponding to individual call messages destined to a user and selective call numbers corresponding to information messages.

4. A radio selective call receiver according to claim 1, further comprising a storage section, and wherein said recognizing section stores said latest reception time in said storage section, said control section reads out said latest reception time from said storage section at said comparison timing, and compares said time difference between said current time and said latest reception time and said predetermined time period.

5. A radio selective call receiver according to claim 4, wherein said comparison timing is predetermined.

6. A radio selective call receiver according to claim 5, wherein said comparison timing is a changing timing of date.

7. A radio selective call receiver according to claim 1, wherein said control section outputs said alarm instruction to said alarm section when said time difference is larger than said predetermined time period.

8. A radio selective call receiver according to claim 7, wherein said predetermined time period is shorter than a time period for which a service is effective.

9. A radio selective call receiver according to claim 7, wherein said control section returns to a call waiting state without outputting said alarm instruction to said alarm section when said time difference is equal to or smaller than said predetermined time period.

10. A method of managing a time difference between message receptions in a radio selective call receiver, comprising:

detecting a message and a selective call number from a received radio signal;

recognizing selectively a reception time of said message as a latest reception time based on a kind of said selective call number;

comparing at a comparison timing, a time difference between a current time and said latest reception time and a predetermined time period;

generating an alarm based on the comparing result.

11. A method according to claim 10, wherein said recognizing includes:

recognizing said reception time of said message when said selective call number is one selective call numbers corresponding to individual call messages destined to a user.

12. A method according to claim 10, wherein said recognizing includes:

recognizing said reception time of said message when said selective call number is one of a preset ones of selective call numbers corresponding to individual call messages destined to a user and selective call numbers corresponding to information messages.

13. A method according to claim 10, further comprising storing said latest reception time in a storage section, and wherein said generating includes:

reading out said latest reception time from said storage section at said comparison timing; and comparing said time difference between said current time and said latest reception time and said predetermined time period.

14. A method according to claim 13, wherein said comparison timing is predetermined.

15. A method according to claim 14, wherein said comparison timing is a changing timing of date.

16. A method according to claim 10, wherein said generating includes:

generating an alarm when said time difference is larger than said predetermined time period.

17. A method according to claim 16, wherein said predetermined time period is shorter than a time period for which a service is effective.

18. A method according to claim 16, wherein said generating includes:

executing a call waiting operation without generating said alarm when said time difference is equal to or smaller than said predetermined time period.

* * * * *